US005528776A

United States Patent [19]

Carmichael

[11] Patent Number: 5,528,776

[45] Date of Patent: Jun. 25, 1996

[54] PORTABLE PUMP OPERATED WASHING BASIN

[76] Inventor: Jacqueline Carmichael, 3 I Cameron Ct., Baltimore, Md. 21236

[21] Appl. No.: 371,209

[22] Filed: Jan. 11, 1995

[51] Int. Cl.[6] ..... A45D 19/04

[52] U.S. Cl. ..... 4/516; 4/518

[58] Field of Search ..... 4/516, 518, 519, 4/625, 626, 515; 132/272

[56] References Cited

U.S. PATENT DOCUMENTS

| | | | |
|---|---|---|---|
| 2,455,607 | 12/1948 | Price | 4/515 |
| 2,682,058 | 6/1954 | Wolfe | 4/516 |
| 2,760,207 | 8/1956 | Glintz | 4/516 |
| 3,449,771 | 6/1969 | Watson | 4/515 |
| 3,579,656 | 5/1971 | Guarrasi | 4/519 |
| 4,651,361 | 3/1987 | Nolan | 4/516 |

FOREIGN PATENT DOCUMENTS

| | | | |
|---|---|---|---|
| 1309939 | 10/1962 | France | 4/516 |
| 4032121 | 11/1991 | Germany | 4/626 |

*Primary Examiner*—Robert M. Fetsuga
*Attorney, Agent, or Firm*—Walter G. Finch; Nancy A. Smith

[57] ABSTRACT

The invention provides for a portable washing device which can be used to wash a person's hair. The device has a wash basin which is formed of two parts, and upper and a lower portion. The lower portion of the basin has a slanted inner liner which causes water to flow to a drain at the back end of the basin. The upper portion is open with a curved, cushioned edge. Between the upper and lower portion of the wash basin is a mesh screen which allows the wash water to flow through. Attached to the wash basin is a removable, refillable water tank. The water tank is connected to sprayer having an adjustable nozzle and has a water level monitor. The water is pumped from the tank to the sprayed and sprayed over the top portion of the basin. The device is ideal for washing an invalid's hair.

14 Claims, 3 Drawing Sheets

PORTABLE PUMP OPERATED WASHING BASIN

TECHNICAL FIELD OF THE INVENTION

This invention relates to washing devices, and more specifically to portable washing devices which can be used to wash a person's hair, a pet or for any portable washing application.

BACKGROUND AND SUMMARY OF THE INVENTION

Generally, devices used for washing hair can be divided into two categories: 1) those which are used in hair salons and are permanent fixtures in the shop, such as basins and sinks; and 2) those which are used on other persons either at home or in an institution and are portable.

Portable hair washing devices have been invented for individuals with limited physical mobility who are not easily able to either wash their own hair or get to a sink to have their hair washed. These portable devices have been designed for use on a person who is immobile. However, none of the prior devices provides an effective and efficient way to wash a person's hair in which both the basin for washing hair and the source of water for washing are both portable.

In U.S. Pat. No. 4,651,361, issued to Nolan, a device which functions as a portable hair shampoo basin and drying hood is disclosed. The basin is formed of two-layers with apertures in the upper layer allowing water to flow through to the bottom layer and out the water drain. However, there is no source of water included in the device, and water must be supplied from an outside source.

U.S. Pat. No. 4,769,861, issued to Chang, discloses an automatic hairwashing device wherein a person's hair is washed in an automated fashion by a plurality of motor driven rubbing rods. The system is formed by two shells and water and shampoo are flushed through the shells by a hose.

Neither of these devices provides for a basin which is connected to a source of water such as a tank and a spray nozzle which delivers water from the tank in a spray over the person's hair.

The device of the present invention provides for a wash basin which has an upper and lower portion. A person's head is positioned so that their neck is resting on a cushioned lip of the upper portion of the wash basin. The cushioned lip is curved downward at one spot to allow for comfortable placement of the person's neck.

Positioned in between the upper and lower portion of the wash basin is a mesh screen which allows water to flow into the lower portion and away from the person's hair. The lower portion of the wash basin is fitted with a slanting inner bottom which is angled to direct the flow of water downward and toward the back end of the device. There, the run off water is released through a water drain in the basin.

Connected to the back of the device is a water tank which holds a sufficient volume sufficient volume of water to wet and rinse a person's hair during the washing procedure. Connected to the water tank is a hose and spray nozzle for dispensing the water. The tank can be operated by using an electric pump, manual pump or other suitable means.

The water drain of the basin can be connected to a hose which is run to a sink or bucket for release of the water. It can also be connected to a reservoir bag which collects the run off water.

Therefore it is an object of this invention to provide for a portable washing device which is self-contained.

It is a further object of this invention to provide for a portable washing device which has a pumped water supply which is dispensed by a spray nozzle.

It is another object of this invention to provide for a portable washing device which has a pressurized tank from which water is pumped to the spray nozzle.

It is yet another object of this invention to provide for a portable washing system which is specifically designed for washing a person's hair so that the person's head is placed in a wash basin and is separated from the runoff water.

DETAILED DESCRIPTION OF THE DRAWINGS

Figure 1:
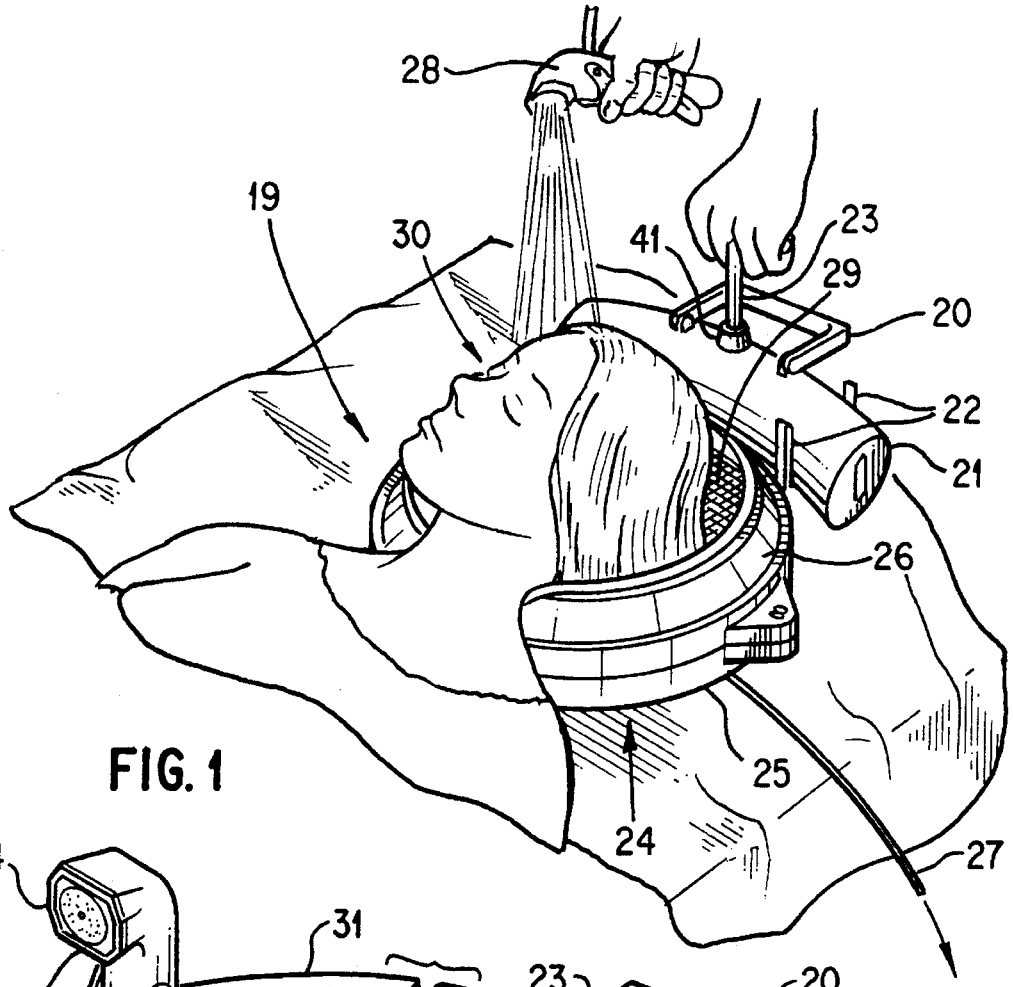
FIG. 1 is perspective view of the device as it is used to wash a person's hair.
Figure 2:
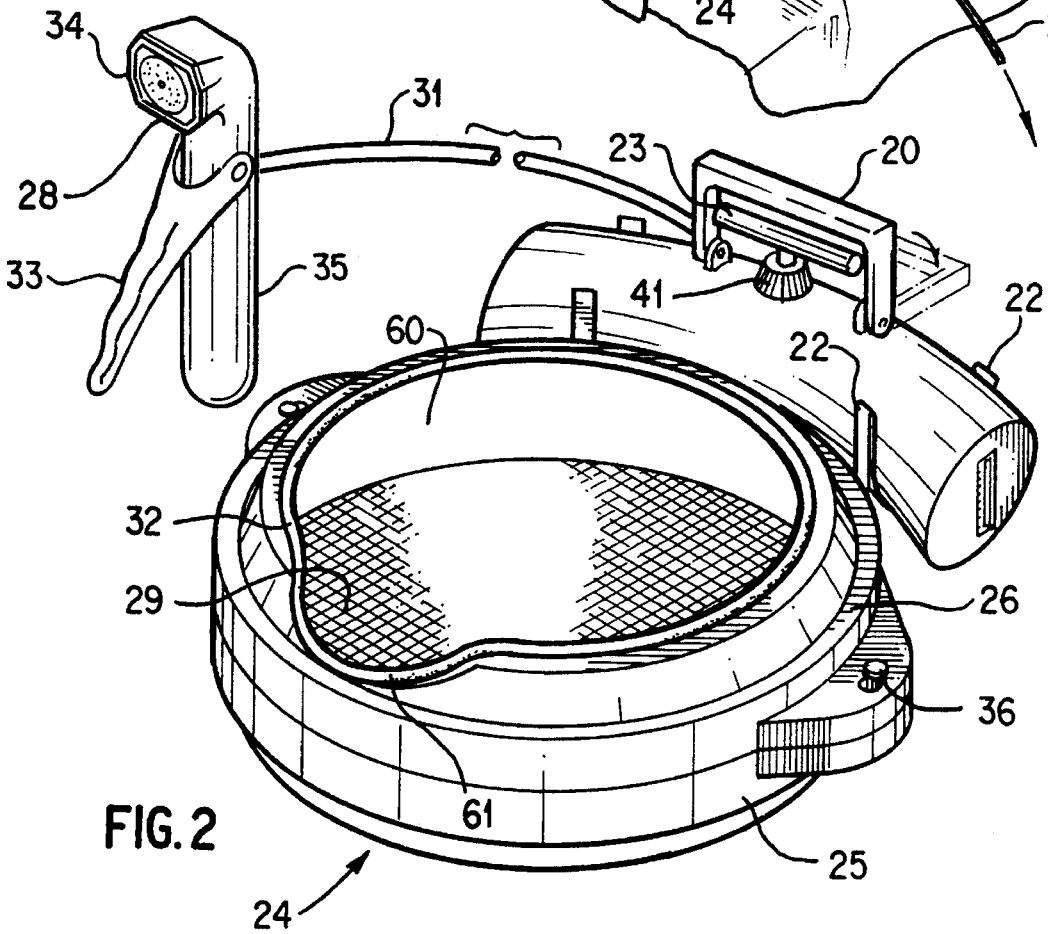
FIG. 2 is a top perspective view of the device.

The portable hair washing device 19 of the present invention is shown in FIG. 1 in use on a person 30. FIG. 2 is an overall view of one embodiment of the device. The person's head 30 rests in opening 60 of the wash basin 24, with their neck resting on the curved portion 61 of the cushioned lip 32 of the upper portion of the wash basin 26. The cushioned lip 32 is removable for replacement if necessary.

The wash basin 24 has both an upper portion 26 and a lower portion 25. The upper portion of the wash basin 26 has an extended lip 50 which fits inside of the extended lip 49 of the lower portion of the wash basin 25.

Figure 6:
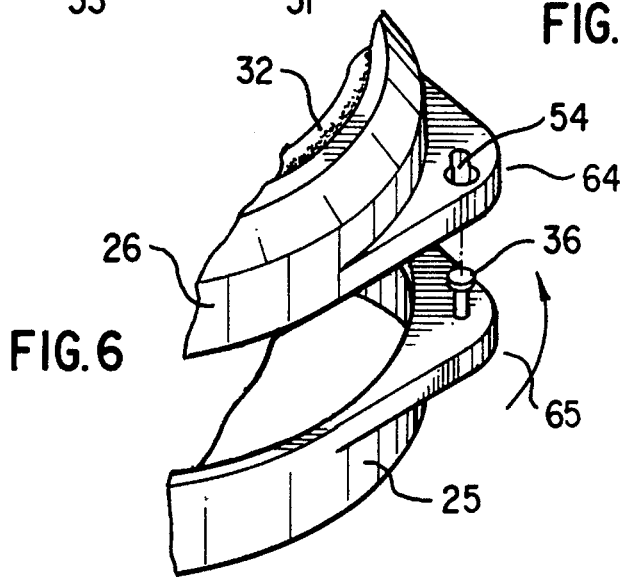
FIG. 6 is an enlarged view of the connection between the upper and lower portion of the device.

FIG. 6 shows in detail one method of connecting the upper portion of the wash basin 26 to the bottom portion of the wash basin 25 so that they are easily locked together or detached. On both the upper portion of the wash basin 26 and the lower portion of the wash basin 25 there are extended edges 64 and 65 on either side of the device.

A notched aperture 54 is formed in both of the extended edges 64 of the upper portion of the wash basin 26 for receiving a locking pin 36 which is positioned at a corresponding spot on the extended edge 65 of the lower portion of the wash basin 25. The locking pin 36 fits into the larger end of the notched aperture 54 and slides into the smaller end of the notched aperture 54 such that the locking pin 36 is secured into place and the upper portion of the wash basin 26 is fastened to the lower portion of the wash basin 25 forming the complete wash basin 24.

The head and hair of the person 30 are positioned inside of the opening 60 in the upper portion of the wash basin 26 such that the hair to be washed is situated over the mesh screen 29. The mesh screen 29 is connected to the upper portion of the wash basin 26. The mesh screen 29 allows water to flow through to the lower portion 25 of the wash basin so that the person's hair is not in contact with the run off water.

Water for washing the person's hair is provided by means of a sprayer 28. The sprayer 28 is connected to a water tank 21 by means of a flexible sprayer tube 31. The sprayer 28 is activated by compressing the lever 33 towards the handle 35. The stream of water is adjusted by turning the nozzle 34 of the sprayer 28 to increase or decrease the flow of water. The sprayer 28 is used to wet the person's hair before washing and to rinse the hair as well.

Figure 5:
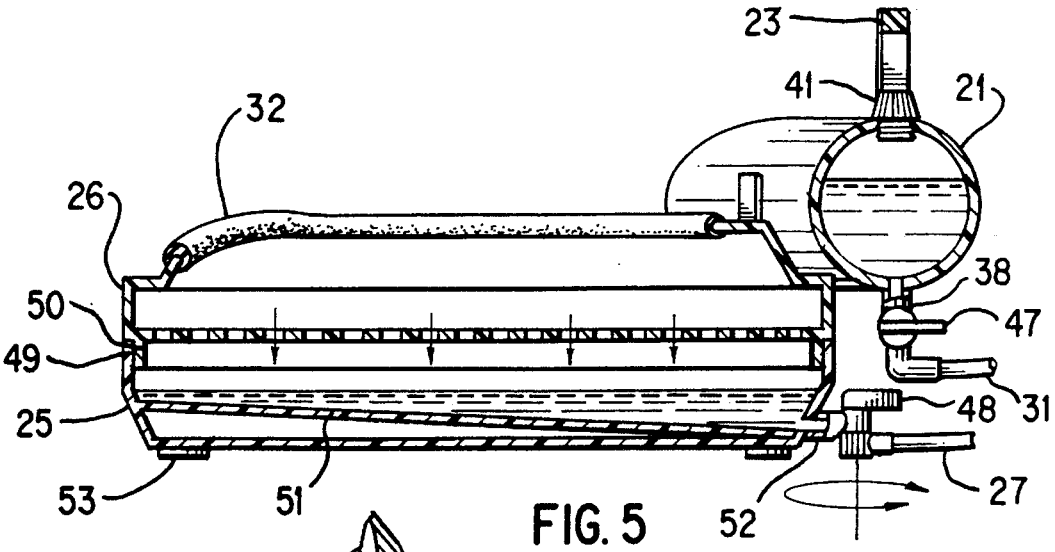
FIG. 5 is a side cross-sectional view through the device.

Water is added to the water tank 21 the fill hole 62 in the top of the water tank which is secured by tank plug 41. Tank plug 41 can be a screw cap as shown in FIG. 5 or another type of cap such as a rubber plug.

The water tank 21 holds a sufficient volume of water for one washing and rinsing cycle. The water level of the tank 21 can be determined by viewing it through the water level monitor 37 positioned on the side of the water tank 21. This allows the user to determine the amount of water remaining in the tank 21 at a glance.

If the user determines that there is not enough water remaining in the tank 21 to finish the wash, then the tank 21 is easily removable from the wash basin 24 for rapid refilling. The water tank mounts onto the back of the wash basin 24 by means of two U-shaped clips 22 which are connected to the upper portion of the wash basin 26. The water tank 21 slides in and out of the U-shaped clips 22, however the clips 22 are tight enough to prevent the water tank 21 from falling out.

The water tank 21 can be designed with or without a handle 20 for convenience in carrying. The handle 20 can pivot for access to the tank plug 41, etc.

Figure 3:
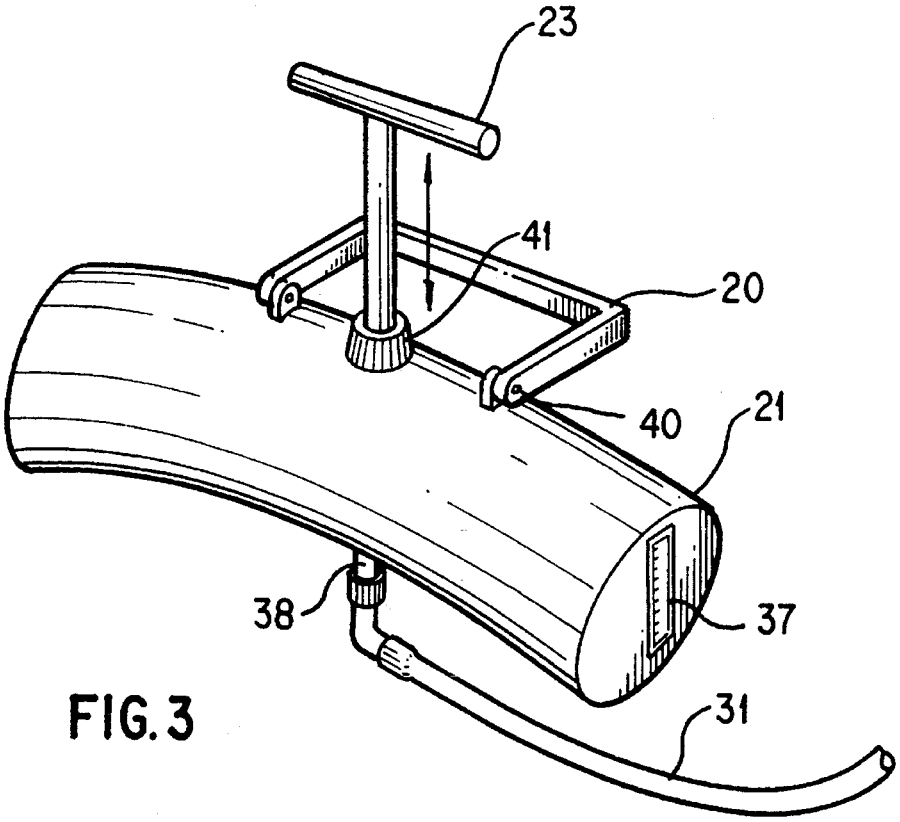
FIG. 3 is an enlarged view of the water tank and manual pump.

The water in the tank 21 is pressurized by means of a pump mechanism. In one embodiment of the invention the pump mechanism is a manual pump as shown in FIG. 3. It is activated by depressing the pump handle 23 into the tank 21 through the tank plug 41, thereby increasing the air pressure over the water. The water exits out the bottom of the water tank 21 through the water tank outlet valve 38. Connected to the water tank outlet valve 38 is the sprayer tube 31. The flow of water out of the water tank 21 can be controlled by a tank stop cock 47.

Figure 4:
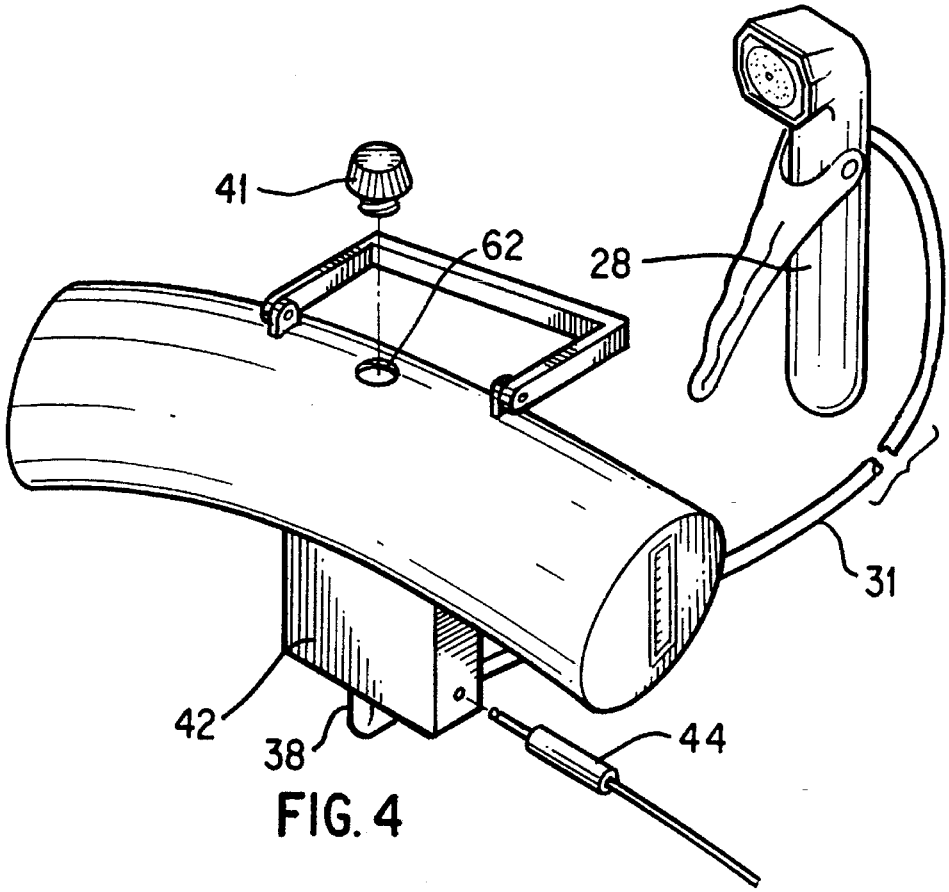
FIG. 4 is an enlarged view of the water tank and electrical pump.

In a second embodiment of the invention shown in FIG. 4, the pump mechanism for the water tank is an electrical pump 42 which can be powered by a portable AC adapter means which is connected to the electrical pump 42 by means of an AC connector 44.

In the second embodiment shown in FIG. 4 the sprayer 28 is also activated by compressing the lever 33 towards the handle 35. The stream of water is adjusted by turning the nozzle 34 of the sprayer 28 to increase or decrease the flow of water.

In this embodiment the sprayer 28 is connected by the flexible sprayer tube 31 to the electrical pump 42. The electrical pump draws water from the water tank 21 and causes it to flow through the sprayer tube 31 into the sprayer 28.

FIG. 5 shows a cross-sectional view of the portable hair washing device 19 such that the internal features of the device 19 can be viewed. In the lower portion of the wash basin 25 there is a slanted inner liner 51 which angles downward from the front of the device to the back of the device near the water tank 21. This slanted inner liner 51 forces the water to flow downward toward the back of the lower portion of the wash basin 25 and into the wash basin outlet valve 52.

The flow of water out of the outlet valve 52 of the lower portion of the wash basin 25 is controlled by a stop cock 48. A flexible drain hose 27 is attached to the stop cock 48. Water flows through the drain hose 27 into the desired receptacle.

Figure 8:
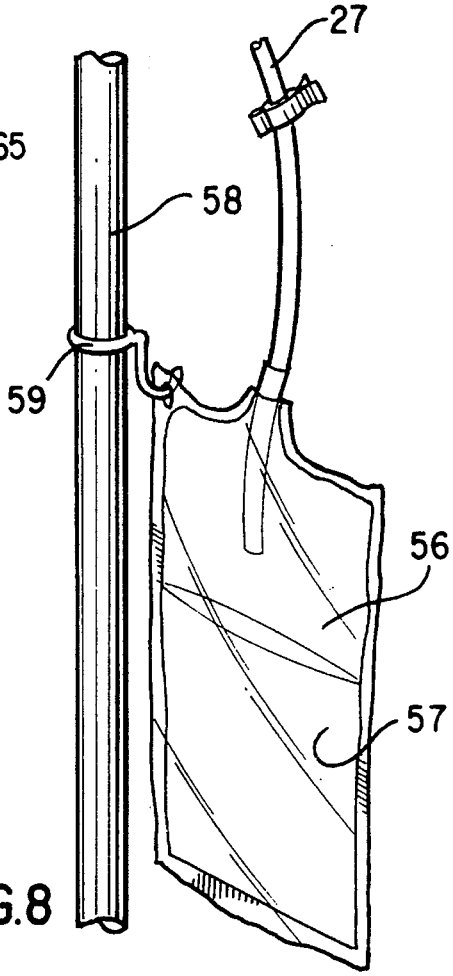
FIG. 8 is a perspective view of the reservoir bag.

FIG. 8 shows one type of receptacle which can be used to collect the used water. The drain hose 27 is connected to a reservoir bag 56 which can be hooked 59 onto an IV pole 58 or the bed post. The level of water 56 in the bag is easily ascertained at a glance. Another way to collect the run off water is to allow it to drain through the drain hose 27 and into a bucket, or to employ a sufficient length of drain hose 27 so that the water can flow directly into a sink.

Figure 7:
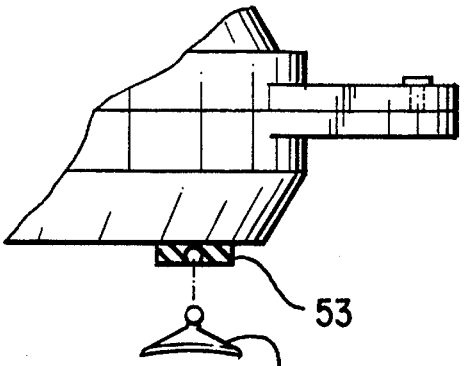
FIG. 7 is an enlarged view of the bottom of the device.

FIG. 7 shows a closeup view of a method of stabilizing the device 19 by attaching suction cups 55 to the pads 53 located on the underside of the lower portion of the wash basin 25.

It is understood that variations can be made to the above description without departing from the intended scope of the invention.

What is claimed is:

1. A portable washing device, comprising:

a wash basin having an interlockable cylindrical upper sieve-like portion with solid side walls being terminated by a detachable mesh screen, said mesh screen separating hair from waste water, and a complementary interlockable cylindrical lower receptacle portion for receiving said waste water;

a removable tank for holding wash water;

a sprayer connected to said tank for spraying said wash water; and a pump means for pumping said wash water from said tank to said sprayer.

2. A portable washing device, as recited in claim 1, wherein said lower portion of said wash basin has a funnel portion for causing said wash water to flow downwardly and a drain for releasing said wash water from said basin.

3. A portable washing device, as recited in claim 2, and additionally a reservoir means for collecting said wash water which is connected to said drain for releasing said wash water from said basin.

4. A portable washing device as recited in claim 2 or 3, wherein said drain for releasing said wash water is an outlet valve.

5. A portable washing device as recited in claim 4, wherein said outlet valve has a switch means for opening and closing said valve.

6. A portable washing device as recited in claim 2, wherein said funnel portion for causing said wash water to flow downward is a slanted inner liner.

7. A portable washing device as recited in claim 6, wherein said slanted inner liner is rigidly joined to said lower portion of said wash basin.

8. A portable washing device as recited in claim 1, wherein said pump means is an electrical pump having a portable detachable power source.

9. A portable washing device as recited in claim 1, wherein said pump means is a manual pump.

10. A portable washing device as recited in claim 1, wherein said tank is attached to said wash basin.

11. A portable washing device as recited in claim 10, wherein said tank is attached to said wash basin by two resilient U-shaped clips such that said tank can be attached and detached from said U-shaped clips easily.

12. A portable washing device as recited in claim 1, wherein said upper portion of said wash basin has an open top having an edge with a sloping curved portion and cushion covering said edge of said open top.

13. A portable washing device as recited in claim 1, wherein said sprayer is further comprised of a handle, a nozzle and a lever, whereby when said lever is compressed toward said handle said wash water flows out of said nozzle and wherein said nozzle has an adjustment means to adjust the flow of said wash water.

14. A portable washing device as recited in claim 1, wherein said tank has a water level monitor.

* * * * *